US008962967B2

(12) United States Patent
Yoshikawa

(10) Patent No.: US 8,962,967 B2
(45) Date of Patent: Feb. 24, 2015

(54) MUSICAL INSTRUMENT WITH NETWORKING CAPABILITY

(75) Inventor: Yoshinari Yoshikawa, Los Altos, CA (US)

(73) Assignee: Miselu Inc., Mountain View, CA (US)

( * ) Notice: Subject to any disclaimer, the term of this patent is extended or adjusted under 35 U.S.C. 154(b) by 390 days.

(21) Appl. No.: 13/239,211

(22) Filed: Sep. 21, 2011

(65) Prior Publication Data

US 2013/0068085 A1 Mar. 21, 2013

(51) Int. Cl.

| | |
|---|---|
| ***G10H 1/32*** | (2006.01) |
| ***G10H 3/00*** | (2006.01) |
| ***G10H 1/00*** | (2006.01) |

(52) U.S. Cl.

CPC ..... *G10H 1/0058* (2013.01); *G10H 2220/096* (2013.01); *G10H 2220/221* (2013.01); *G10H 2220/355* (2013.01); *G10H 2230/015* (2013.01); *G10H 2240/175* (2013.01); *G10H 2240/305* (2013.01)

USPC ..... 84/744

(58) Field of Classification Search

USPC ..... 84/645, 743, 744

See application file for complete search history.

(56) References Cited

U.S. PATENT DOCUMENTS

| | | | | |
|---|---|---|---|---|
| 4,480,519 | A | 11/1984 | Allen | |
| 5,496,963 | A * | 3/1996 | Ito | 84/653 |
| 5,656,789 | A * | 8/1997 | Nakada et al. | 84/477 R |
| 5,890,017 | A * | 3/1999 | Tulkoff et al. | 710/65 |
| 7,129,408 | B2 * | 10/2006 | Uehara | 84/645 |
| 7,247,788 | B2 * | 7/2007 | Lai | 84/719 |
| 7,288,712 | B2 * | 10/2007 | Uehara | 84/645 |
| 7,332,669 | B2 * | 2/2008 | Shadd | 84/742 |
| 7,405,355 | B2 * | 7/2008 | Both et al. | 84/645 |
| 7,511,215 | B2 * | 3/2009 | Bicker | 84/645 |
| 7,745,713 | B2 * | 6/2010 | Fukada et al. | 84/600 |
| 7,786,371 | B1 * | 8/2010 | Moates | 84/645 |
| 7,947,889 | B2 * | 5/2011 | Usa et al. | 84/615 |
| 7,989,689 | B2 * | 8/2011 | Sitrick et al. | 84/723 |
| 7,991,897 | B2 * | 8/2011 | Umezawa et al. | 709/228 |
| 8,035,020 | B2 * | 10/2011 | Taub et al. | 84/600 |
| 8,044,289 | B2 * | 10/2011 | Toledano et al. | 84/600 |
| 8,158,875 | B2 * | 4/2012 | Stanger Ramirez | 84/645 |
| 8,367,921 | B2 * | 2/2013 | Evans et al. | 84/609 |
| 8,487,173 | B2 * | 7/2013 | Emmerson | 84/601 |
| 8,525,013 | B2 * | 9/2013 | Bicker | 84/645 |
| 8,598,444 | B2 * | 12/2013 | Morrissey et al. | 84/743 |

(Continued)

OTHER PUBLICATIONS

"ION, Piano 2 Go, Portable Musical Keyboard for iPod, iPhone and iPad"; Ionaudio.com; 1 page.

*Primary Examiner* — Jeffrey Donels

(74) *Attorney, Agent, or Firm* — Trellis IP Law Group, PC

(57) ABSTRACT

Disclosed is a musical instrument with networking capability and application-driven features for expanding mobility and sharing of creations made using the instrument. In one embodiment, a musical instrument with networking capability, can include: a musical keyboard having a plurality of first keys and a plurality of second keys in a pattern that is repeatable at an octave, where the first keys are shorter and raised relative to the second keys; a touchscreen attached to the musical keyboard, where the touchscreen is movable between a flattened position and a collapsed position that is over the musical keyboard; a device connection interface configured to support a plurality of external connections; and a controller coupled to the musical keyboard, the touchscreen, and the device connection interface.

10 Claims, 6 Drawing Sheets

(56) References Cited

U.S. PATENT DOCUMENTS

| | | | | |
|---|---|---|---|---|
| 2002/0108484 | A1 | 8/2002 | Arnold et al. | |
| 2007/0080892 | A1 | 4/2007 | Rebeske | |
| 2007/0214946 | A1* | 9/2007 | Usa | 84/645 |
| 2008/0163747 | A1* | 7/2008 | Uehara et al. | 84/645 |
| 2008/0190271 | A1* | 8/2008 | Taub et al. | 84/645 |
| 2009/0003794 | A1 | 1/2009 | Heatherly | |
| 2009/0178533 | A1* | 7/2009 | Koseki et al. | 84/171 |
| 2009/0301289 | A1* | 12/2009 | Gynes | 84/645 |
| 2010/0064883 | A1* | 3/2010 | Gynes | 84/645 |
| 2010/0195279 | A1* | 8/2010 | Michael | 361/679.41 |
| 2011/0051665 | A1 | 3/2011 | Huang | |
| 2012/0144977 | A1* | 6/2012 | Morrissey et al. | 84/602 |
| 2012/0174738 | A1* | 7/2012 | Kim | 84/645 |
| 2012/0204703 | A1* | 8/2012 | Paterson et al. | 84/470 R |
| 2013/0068086 | A1* | 3/2013 | Mittelstadt et al. | 84/645 |

* cited by examiner

MUSICAL INSTRUMENT WITH NETWORKING CAPABILITY

BACKGROUND

Many musical instruments, such as pianos, guitars, drums, etc., are enjoyed by both accomplished and aspiring musicians. However, many people who have a great admiration for music and musical instruments do not follow their interests beyond simple aberration. Part of the problem results from limited features and mobility a certain musical instruments. For example, some instruments may be difficult to move from place to place in an increasingly mobile society. In addition, some potential musicians may lose interest in a certain instrument due to the restricted or isolated nature of that instrument.

SUMMARY

In particular embodiments, a musical instrument with networking capability and application-driven features is provided in order to expand mobility and sharing of creations made using the instrument.

In one embodiment, a musical instrument with networking capability, can include: a musical keyboard having a plurality of first keys and a plurality of second keys in a pattern that is repeatable at an octave, where the first keys are shorter and raised relative to the second keys; a touchscreen attached to the musical keyboard, where the touchscreen is movable between a flattened position and a collapsed position that is over the musical keyboard; a device connection interface configured to support a plurality of external connections; and a controller coupled to the musical keyboard, the touchscreen, and the device connection interface.

In another embodiment, a method of sharing music created by a musical instrument with networking capability, can include: detecting a location of the musical instrument; recording audio generated from a musical keyboard, where the musical instrument comprises the musical keyboard attached to a touchscreen; recording video via a camera on the musical instrument; forming a music video by combining the recorded audio with the recorded video; tagging the music video with the detected location; and sharing the tagged music video via a social networking service (SNS).

A further understanding of the nature and the advantages of particular embodiments disclosed herein may be realized by reference of the remaining portions of the specification and the attached drawings.

DETAILED DESCRIPTION OF EMBODIMENTS

Particular embodiments provide for a mobile musical instrument with networking capability, and that utilizes application-driven features. Particular embodiments provide for a "social" music device by accommodating sharing of music and video, such as via social networking service (SNS) applications. In addition, the musical instrument of particular embodiments is expandable to accommodate a larger keyboard and/or other instruments. Further, particular embodiments also utilize an operating system (e.g., Google/Android) in a portable and compact structure.

Figure 1:
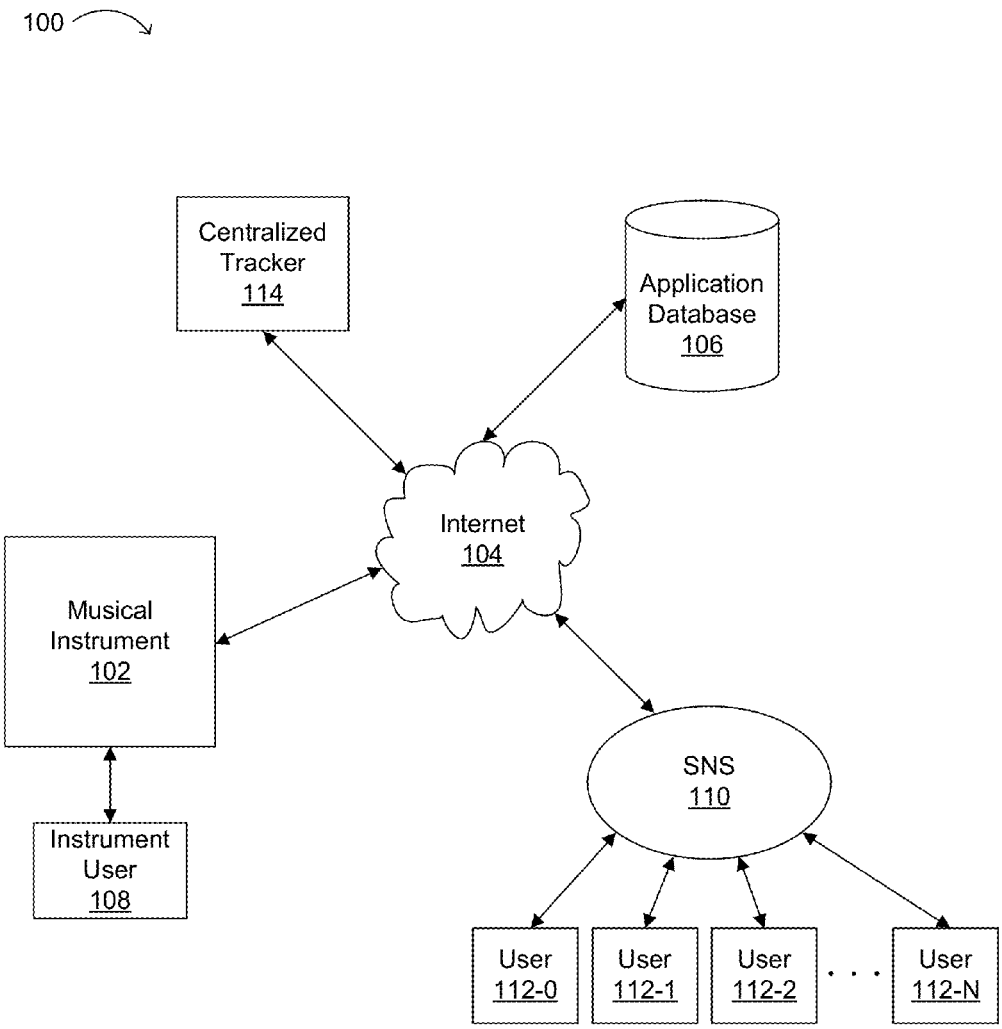
FIG. 1 depicts an example musical instrument networking arrangement.

Particular embodiments relate to a musical instrument that is able to share information, such as music videos created using the musical instrument, with other users via the Internet. For example, FIG. 1 shows one such example musical instrument networking arrangement 100. Musical instrument 102 can connect to Internet 104 to allow instrument user 108 to share information with other users 112 (e.g., 112-0, 112-1, 112-2, . . . 112-N). For example, users 112 may utilize SNS 110 for sharing via Internet 104. Any suitable SNS (e.g., Facebook, twitter, YouTube, Ustream, SoundCloud, etc.), as well as any type of network (e.g., the Internet, virtual private network (VPN), etc.) can be supported in particular embodiments.

Application database 106 may store applications for downloading to (e.g., via Internet 104) and use on musical instrument 102. For example, application database 106 can support an application store whereby instrument user 108 can access applications for musical instrument 102. Any suitable applications (e.g., Shazam, Tunewiki, SoundHound, FingerPiano, etc.) can be supported on musical instrument 102 and accessed via application database 106. In this fashion, instrument user 108 can configure musical instrument 102 according to a variety of applications, including applications related to control of music (e.g., pause/skip during a song, etc.). In addition, application database 106 may include original applications created for musical instrument 102.

Centralized tracker 114 may be used to track information about musical instrument 102 and/or musical creations made by using musical instrument 102, as well as other such instruments (e.g., those used by users 112). In addition, centralized tracker 114 may track music that is downloaded to musical instrument 102. For example, centralized tracker 114 may track the locations, musical genres, user identifiers, musical instrument or device identifiers, etc., for any such musical creations. Centralized tracker 114 may generate statistics, such as which geographical region or area creates, or downloads, the most of a particular type of music by using the musical instrument of particular embodiments. For example, the New Orleans area may lead the nation in musical creations/downloads in the jazz genre, while the Seattle area may lead the nation in musical creations/downloads in the grunge genre, and so on.

Figure 2:
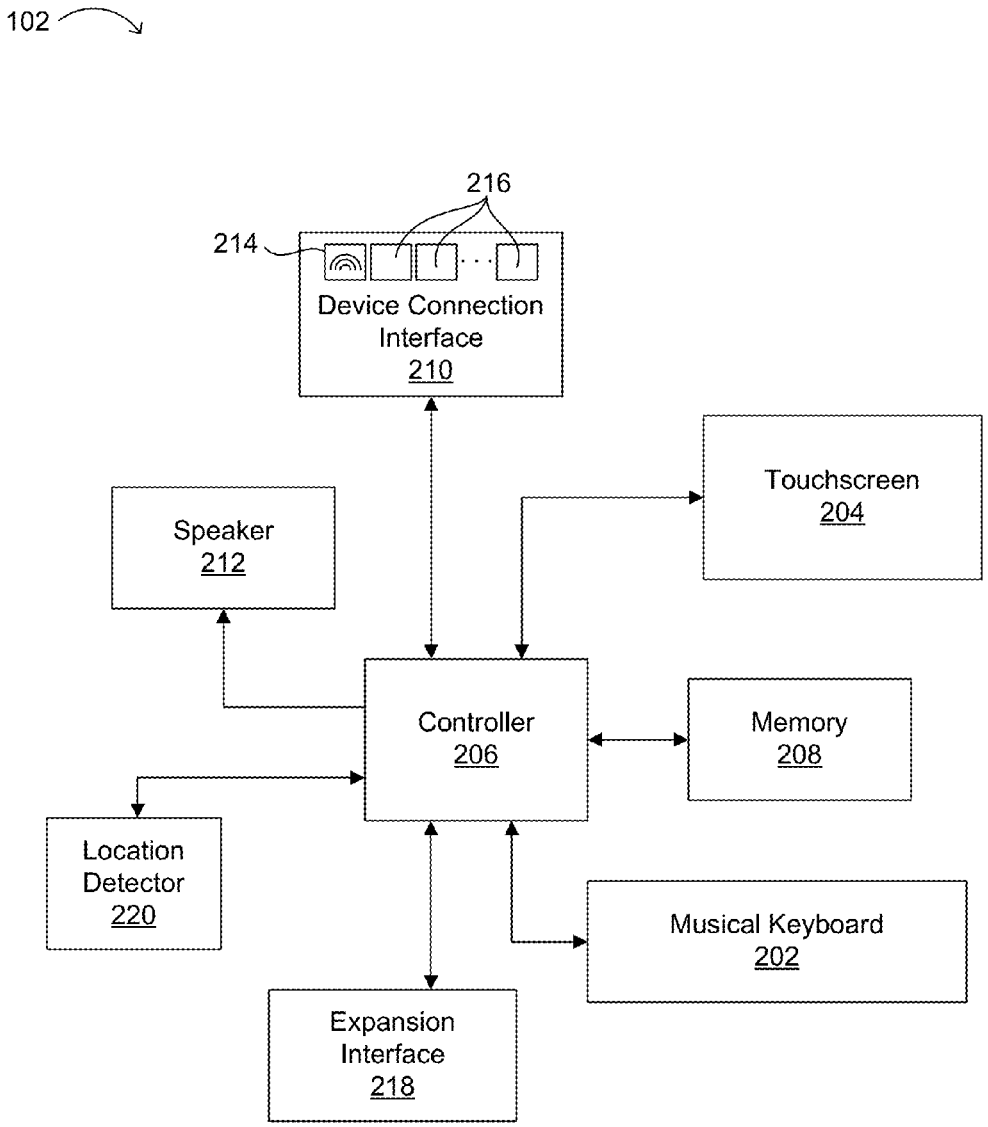
FIG. 2 depicts a functional block diagram of an example musical instrument.

Referring now to FIG. 2, shown is a functional block diagram of an example musical instrument 102. Musical instrument 102 can include musical keyboard 202 and touchscreen 204. For example, musical keyboard 202 can include at least an octave of a standard piano keyboard for playing the twelve notes of the Western musical scale, with a combination of larger, longer keys and smaller, shorter keys that repeats at the interval of an octave. In a standard piano keyboard, the twelve notes of the Western musical scale are laid out with the lowest note on the left, and the longer keys (for the seven "natural" notes of the C major scale: C, D, E, F, G, A, B) jut forward. Because these keys were traditionally covered in ivory they are often called the white notes or white keys. The keys for the remaining five notes that are not part of the C major scale are typically raised and set back. Because these keys receive less wear, they are often made of black colored wood and called the black notes or black keys. The pattern repeats at the interval of an octave.

Touchscreen 204 can include any suitable interactive display surface or electronic visual display that can detect the presence and location of a touch within the display area. Touchscreen 204 may support touching the display with a finger or hand, or any suitable passive object, such as a stylus. Any suitable display technology (e.g., liquid crystal display (LCD), light emitting diode (LED), etc.) can be employed in touchscreen 204. In addition, touchscreen 204 in particular embodiments can utilize any type of touch detecting technology (e.g., resistive, surface acoustic wave (SAW) technology that uses ultrasonic waves that pass over the touchscreen panel, a capacitive touchscreen with an insulator, such as glass, coated with a transparent conductor, such as indium tin oxide (ITO), surface capacitance, mutual capacitance, self-capacitance, projected capacitive touch (PCT) technology, infrared touchscreen technology, optical imaging, dispersive signal technology, acoustic pulse recognition, etc.).

Controller 206 may interface with musical keyboard 202 and touchscreen 204, as well as memory 208, device connection interface 210, speaker 212, expansion interface 218, and location detector 220. In particular embodiments, controller 206 may be any suitable processor or controller (e.g., a central processing unit (CPU), a general-purpose microprocessor, a microcontroller, a microprocessor, etc.). Further, any suitable operating system (OS), or mobile OS/platform, may be utilized to manage operation of controller 206, as well as execution of various application software. Examples of operating systems include Android from Google, iPhone OS (iOS), Berkeley software distribution (BSD), Linux, Mac OS X, Microsoft Windows, and UNIX.

Memory 208 can be used for instruction and/or data memory, as well as to store music and/or video files created on or downloaded to musical instrument 102. Memory 208 can be implemented in one or more of any number of suitable types of memory (e.g., static random access memory (SRAM), dynamic RAM (DRAM), electrically erasable programmable read-only memory (EEPROM), etc.). Memory 208 can also include or be combined with removable memory, such as memory sticks (e.g., using flash memory), storage discs (e.g., compact discs, digital video discs (DVDs), Blu-ray discs, etc.), and the like. Interfaces to memory 208 for such removable memory can include a universal serial bus (USB), and may be implemented through a separate connection and/or via device connection interface 210.

Device connection interface 210 can be used to connect other devices and/or instruments to musical instrument 102. For example, connection interface 214 can be used for wireless connectivity (e.g., Wi-Fi, Bluetooth, etc.) to Internet 104 (e.g., navigable via touchscreen 204), or to another device. Connection interfaces 216 can represent various types of connection ports to accommodate corresponding devices or types of connections. For example, additional speakers (e.g., Jawbone wireless speakers, or directly connected speakers) can be added via device connection interface 210. Also, headphones via the headphone jack (e.g., in connection interfaces 216) can also be added directly, or via wireless interface. Connection interfaces 216 can also include a USB interface to connect with any USB-based device.

Device connection interface 210 can also allow for connection of musical instrument 102 with any number of other instruments (e.g., guitar, drums, etc.), either directly or via Internet 104. In some cases, musical keyboard 202 can effectively be replaced by other instruments connected via device connection interface 210, while in other cases such additionally connected instruments may supplement (e.g., to form a band) musical keyboard 202. Thus, various instruments (e.g., a turntable for disc jockeying, drums, piano, etc.) may be coupled together to provide music over a common stream, such as directly via controller 206 and/or via Internet 104.

Speaker 212 can be an integrated speaker between musical keyboard 202 and touchscreen 204 of musical instrument 102. Speaker 212 can be used to play sounds from applications (e.g., movies, music video, piano training applications, etc.) from touchscreen 204 and/or sounds from musical keyboard 202. Speaker 212 can also be supplemented with additional external speakers connected via device connection interface 210, or multiplexed with such external speakers or headphones.

Musical instrument 102 also supports expansion by way of additional musical keyboard sections 202. For example, musical keyboard 202 may support at least one octave, and several instances of musical keyboard 202 can be coupled together to form a larger, and even a full piano, keyboard. For example, two other instances of musical keyboard 202 can be coupled together to expand the keyboard. Expansion interface 218 can be used to detect when another instance of musical keyboard 202 is placed adjacent to a given musical keyboard 202 in order to effectively expand the keyboard. For example, expansion interface 218 can mechanically detect by way of interconnecting grooves on the sides of musical instrument 102. Further, any suitable means of such detection (e.g., electrical) can also be utilized in certain embodiments.

In any event, expansion interface 218 may indicate to controller 206 whether musical keyboard 202 is a standard or expanded version such that the additional keys in an expanded version, as well as additional touchscreen 204 width, can be accommodated. In one application, each touchscreen 204 in an expanded musical instrument can be used to show a different function (e.g., one a music video or movie, and another text corresponding to the movie, a text messaging window, etc.), or the touchscreens can be effectively meshed together to appear as a wider screen (e.g., portions of a music video or movie playing on different screens to form a full movie view).

Location detector 220 can be used to detect the location of musical instrument 102. Any suitable geographic location "geolocation" determination mechanism (e.g., global positioning system (GPS), Internet and computer geolocation, etc.) can be used to determine a location of musical instrument 102. In particular embodiments, "geotagging" or other appropriate tagging, can be used to add geographical identification metadata to various media (e.g., photographs, audio, video, websites, short message service (SMS) messages, really simple syndication (RSS) feeds, etc.) emanating from (or downloaded to) musical instrument 102. For example, such geographic metadata can include any geospatial metadata (e.g., latitude and longitude coordinates, altitude, bearing, distance, accuracy data, place names, etc.), may further be associated with an Internet protocol (IP) address, media access control (MAC) address, radio-frequency identification (RFID), hardware embedded article/production number, embedded software number, Wi-Fi connection location, etc., in addition to the tagged media (e.g., a music video). In this fashion, music and/or video made by music instrument 102 can be "stamped" as coming from the particular device at the location at which the music and/or video was made by determining the location of music instrument 102.

In one particular example, a musical instrument with networking capability includes: a musical keyboard having a plurality of first keys and a plurality of second keys in a pattern that is repeatable at an octave, where the first keys are shorter and raised relative to the second keys; a touchscreen attached to the musical keyboard, where the touchscreen is movable between a flattened position and a collapsed position that is over the musical keyboard; a device connection interface configured to support a plurality of external connections; and a controller coupled to the musical keyboard, the touchscreen, and the device connection interface.

Figure 3:
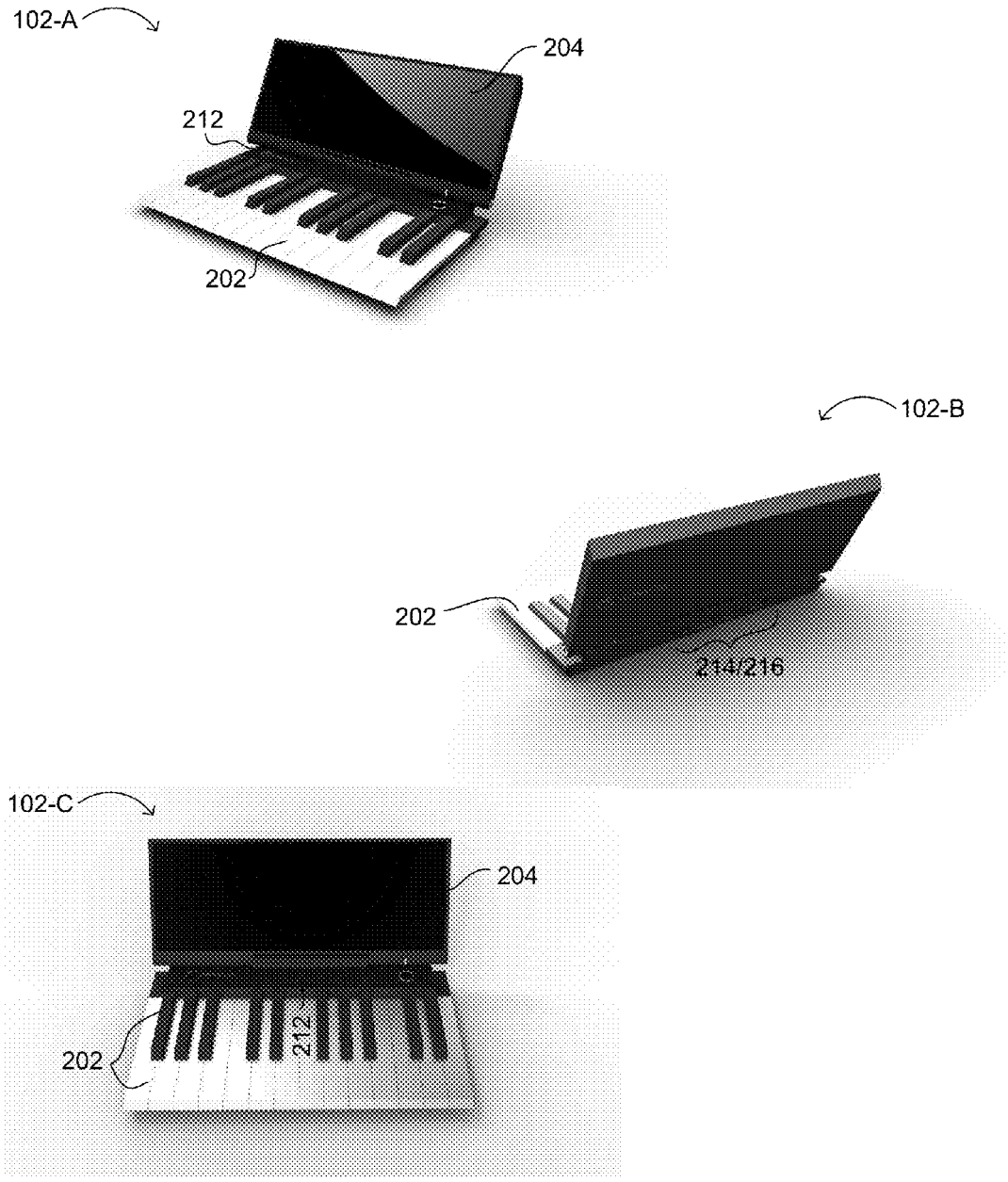
FIG. 3 illustrates various views of an example musical instrument.

FIG. 3 illustrates various views of an example musical instrument. 102-A shows the musical instrument slightly angled with keyboard 202, speaker 212, and touchscreen 204. In certain embodiments, touchscreen 204 may span substantially a width of a musical keyboard 202 to maximize a viewable area. 102-B shows the backside of the musical instrument with device connection interfaces 214/216 (e.g., headphone jack, power connector, USB port, etc.) and a portion of keyboard 202. 102-C shows a direct front view of keyboard 202, speaker 212, and touchscreen 204. As can be seen from keyboard 202, the longer white notes or white keys jut forward, and are for the seven natural notes of the C major scale. The black notes or black keys for the remaining five notes that are not part of the C major scale are shorter and raised relative to the longer white keys. However, while the black keys are raised relative to the white keys, the tops of the black keys may remain at or below a level of speaker 212 in order to allow touchscreen 204 to be collapsed or folded-down over musical keyboard 202.

Figure 4:
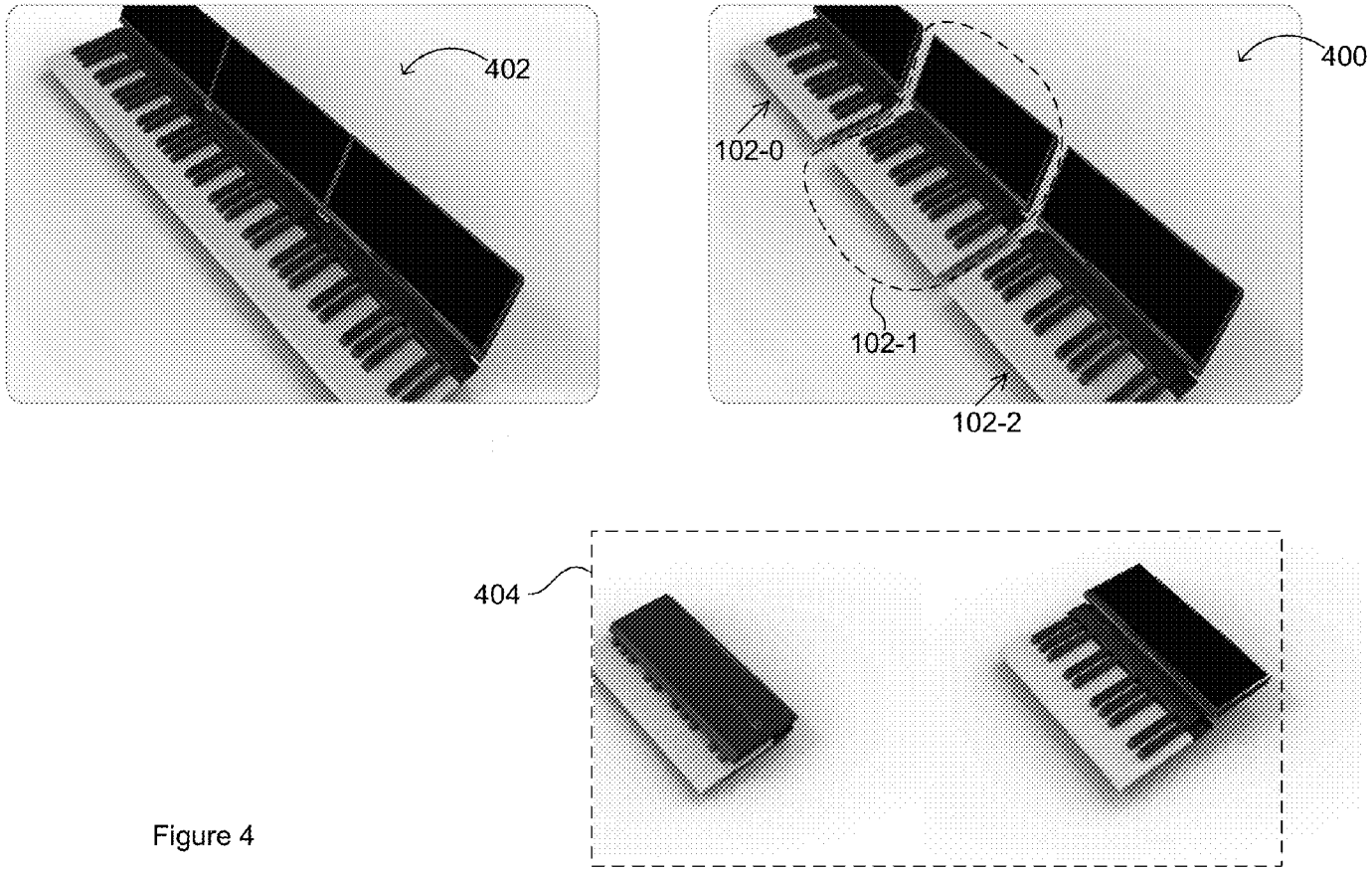
FIG. 4 illustrates an example musical instrument in various configurations.

FIG. 4 illustrates an example musical instrument in various configurations. In 400, musical instrument 102-1 is expanded to the left by musical instrument instance 102-0, and to the right by musical instrument instance 102-2. As shown in 402, the expanded musical instrument includes previously separated musical instruments/instances 102-0, 102-1, and 102-2. Expansion interface 218, discussed above with reference to FIG. 2, may detect adjacently coupled musical instruments in order to appropriately map controls for keyboard 202 and touchscreen 204.

The musical instrument of particular embodiments may also be adjusted to different positions, as shown in 404. For example, touchscreen 204 is movable between a flattened position (e.g., about 190°, as shown on the right side of 404) and a collapsed position (as shown on the left side of 404) that is over the musical keyboard. The musical instrument 102 can also be arranged in a standard position whereby the touchscreen is adjusted to aid viewing by a user of musical keyboard 202. In this fashion, musical instrument 102 is adjustable to suit a variety of positions of touchscreen 204 relative to musical keyboard 202, as well as a variety of expanded (e.g., via adjacent coupling) musical instrument configurations.

Figure 5:
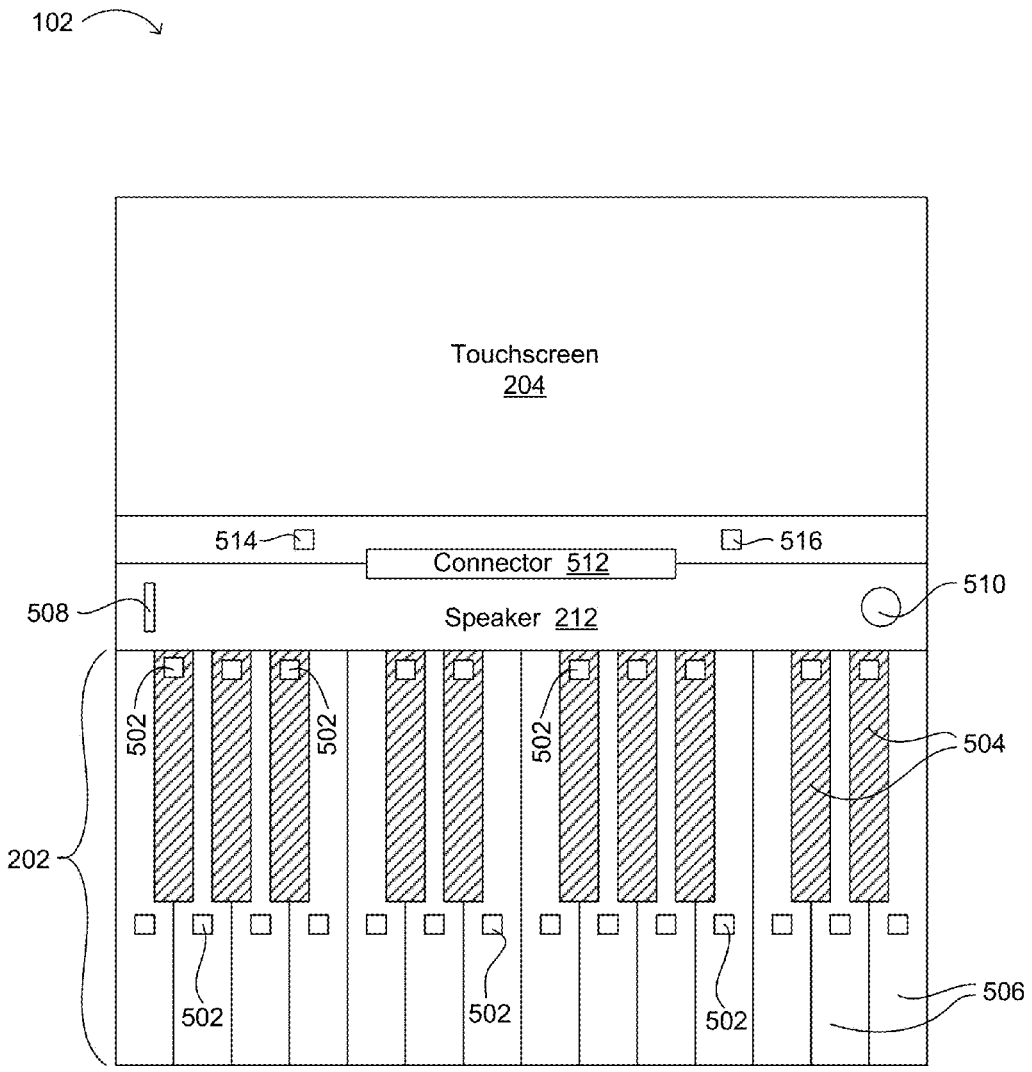
FIG. 5 illustrates an example musical instrument arrangement.

Referring now to FIG. 5, shown is an example musical instrument arrangement, illustrated in the flattened position between touchscreen 204 and musical keyboard 202. Musical keyboard 202 can include longer keys 506 (e.g., white), as well as shorter and raised keys 504 (e.g., black). In addition, each of keys 504 and 506 can include a light 502 embedded therein and that is visible to a user of musical keyboard 202 when turned on or activated. Lights 502 may be implemented in any suitable lighting technology (e.g., LED, organic LED (OLED), etc.). Such lights 502 may indicate which corresponding key to press when playing a particular song. In one example, a piano teaching application may be downloaded (e.g., from application database 106), and may be used to activate lights 502 correspond to the particular teaching point or song to be played.

Such lights 502 may also be used to indicate corresponding notes for any song or musical soundtrack played on musical instrument 102. For example, a movie with the soundtrack or a music video may be played on touchscreen 204, and lights 502 may be activated corresponding to the notes in the soundtrack or music video being played. As another example, lights 502 can indicate which keys were pressed in a musical creation by the user. A user may compose a song, or a portion thereof, using musical keyboard 202, and then store that musical creation in memory 208. At a later time, the user may recall from memory 208 the musical creation, which can activate lights 502 when played. In this fashion, learning to play musical keyboard 202 can be facilitated.

Lights 502 may also be employed to aid in collaboration with other users 112 that may be remote from instrument user 108. For example, shared music creations from one user 112 can be sent to instrument user 108, and played on musical instrument 102. In order for one user 108 to quickly learn the particular notes used by another user 112, this can be visualized by way of lights 502. In another aspect, upcoming keys to be pressed may be indicated on touchscreen 204, and effectively "bubbled" down to key lights 502 at the time the keys are to be pressed to play the music. Thus, lights 502 may be used in conjunction with indicators via touchscreen 204 to both anticipate upcoming notes, as well as current keys to be pressed. Further, lights 502 may be used to indicate which key is to be pressed to play a piece of music, whether that music is originating from musical keyboard 202 or from another user 112.

Musical instrument 102 may also include volume selector 508, and power button 510 dispersed on either side of speaker 212. A light indicating power on may also be included near power on button 510. In order to allow touchscreen 204 to be adjusted relative to musical keyboard 202, connector 512 may be used to allow swivel control. Camera 514 and microphone 516 may also be included in musical keyboard 102 in order to accommodate the creation of music videos, web videos, and the like. Of course, other positioning and arrangement of various lights and indicator buttons can also be accommodated in particular embodiments.

In one particular example, a method of sharing music created by a musical instrument with networking capability includes: detecting a location of the musical instrument; recording audio generated from a musical keyboard, where the musical instrument comprises the musical keyboard attached to a touchscreen; recording video via a camera on the musical instrument; forming a music video by combining the recorded audio with the recorded video; tagging the music video with the detected location; and sharing the tagged music video via an SNS.

Figure 6:
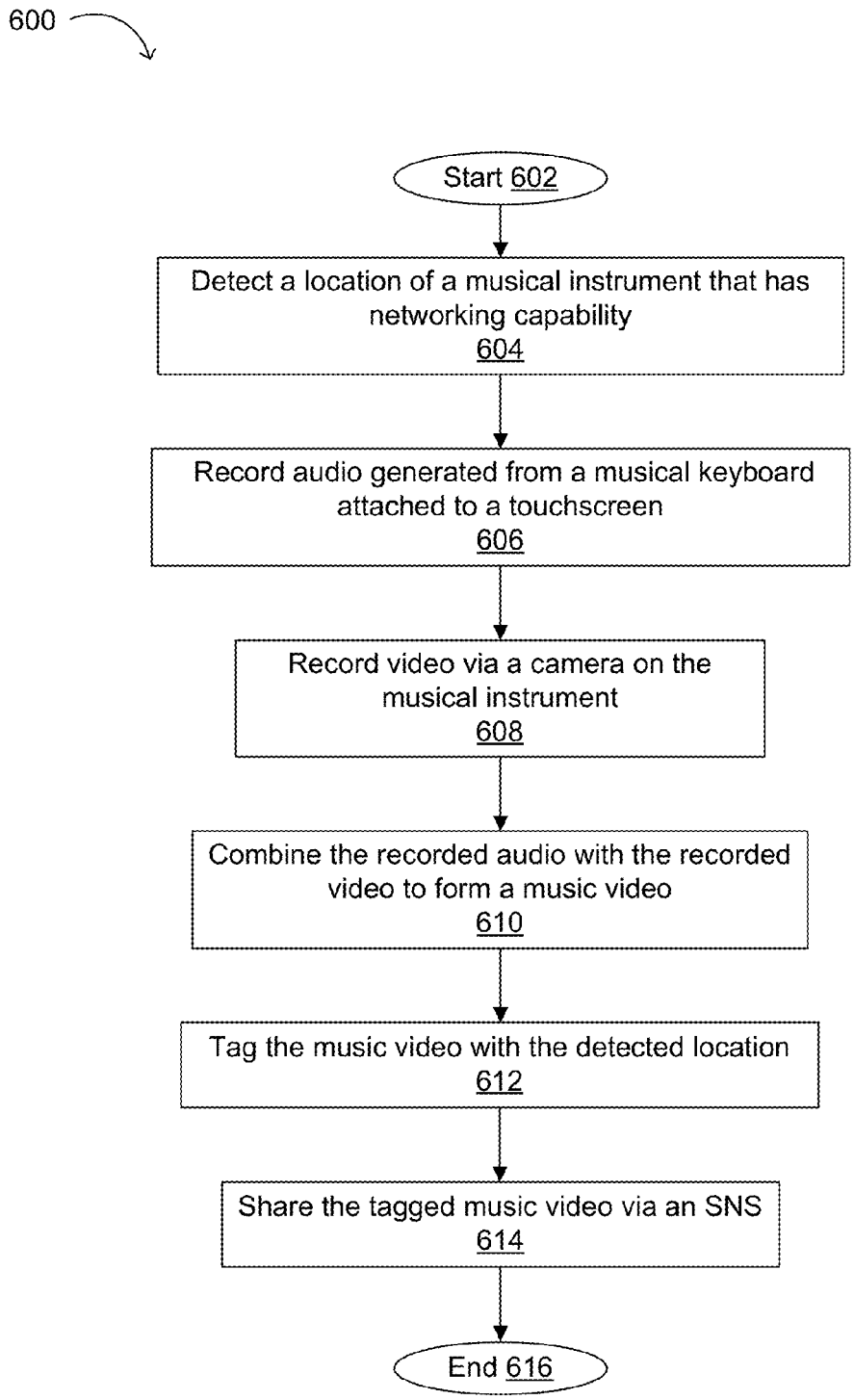
FIG. 6 is a flow diagram of an example method of using a musical instrument.

FIG. 6 is a flow diagram of an example method 600 of using a musical instrument. The flow begins 602, and in 604 a location of the musical instrument may be detected. For example, location detector 220 (e.g., a GPS receiver) may be used to detect location and to provide geographic location information therefrom. In 606, audio generated from a musical keyboard (e.g., 202) attached to a touchscreen (e.g., 204) may be recorded. In 608, video from a camera (e.g., 514) on musical instrument 102 may be recorded. For example, memory 208 may be used to store such recorded audio and video.

In 610, the recorded audio may be combined with the recorded video for a music video. In 612, the music video can be tagged with the detected location. For example, geotagging can be employed to add the location information derived from location detector 220. The tagged music video can be shared via an SNS in 614, completing the flow 616. For example, a tagged music video may be created by instrument user 108 on musical instrument 102, and shared via Internet 104 and SNS 110 with one or more of users 112. As one skilled in the art will recognize, the ordering or sequencing of various steps, as well as the combination of various steps (e.g., 606, 608, and/or 610) in this particular example, may be combined in certain embodiments.

Musical instrument 102 can also include modules to allow for cellular (e.g., a 3G module) or Internet (e.g., a Skype module) based calling. Touchscreen 204 can thus be utilized for applications, videos, teaching tools, videoconferences, video phone calls, and so on. In addition, camera 514 can be used for still photographs, as well as running video, or video constrained while using musical keyboard 202.

Although the description has been described with respect to particular embodiments thereof, these particular embodiments are merely illustrative, and not restrictive. For example, while certain keys in the musical keyboard have been shown, any suitable key or instrument arrangement can be accommodated in particular embodiments. Further, while certain connections and applications have been discussed herein, any suitable connections and applications can be accommodated in particular embodiments.

Any suitable programming language can be used to implement the routines of particular embodiments including C, C++, Java, assembly language, etc. Different programming techniques can be employed such as procedural or object oriented. The routines can execute on a single processing device or multiple processors. Although the steps, operations, or computations may be presented in a specific order, this order may be changed in different particular embodiments. In some particular embodiments, multiple steps shown as sequential in this specification can be performed at the same time.

Particular embodiments may be implemented in a computer-readable storage medium for use by or in connection with the instruction execution system, apparatus, system, or device. Particular embodiments can be implemented in the form of control logic in software or hardware or a combination of both. The control logic, when executed by one or more processors, may be operable to perform that which is described in particular embodiments.

Particular embodiments may be implemented by using a programmed general purpose digital computer, by using application specific integrated circuits, programmable logic devices, field programmable gate arrays, optical, chemical, biological, quantum or nanoengineered systems, components and mechanisms may be used. In general, the functions of particular embodiments can be achieved by any means as is known in the art. Distributed, networked systems, components, and/or circuits can be used. Communication, or transfer, of data may be wired, wireless, or by any other means.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope to implement a program or code that can be stored in a machine-readable medium to permit a computer to perform any of the methods described above.

A "processor" includes any suitable hardware and/or software system, mechanism or component that processes data, signals or other information. A processor can include a system with a general-purpose central processing unit, multiple processing units, dedicated circuitry for achieving functionality, or other systems. Processing need not be limited to a geographic location, or have temporal limitations. For example, a processor can perform its functions in "real time," "offline," in a "batch mode," etc. Portions of processing can be performed at different times and at different locations, by different (or the same) processing systems. A computer may be any processor in communication with a memory. The memory may be any suitable processor-readable storage medium, such as random-access memory (RAM), read-only memory (ROM), magnetic or optical disk, or other tangible media suitable for storing instructions for execution by the processor.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

What is claimed is:

1. A musical instrument with networking capability, the musical instrument comprising:

a musical keyboard having a plurality of first keys and a plurality of second keys in a pattern that is repeatable at an octave, wherein the first keys are shorter and raised relative to the second keys;

a touchscreen attached to the musical keyboard, wherein the touchscreen is movable between a flattened position and a collapsed position that is over the musical keyboard;

a device connection interface configured to support a plurality of external connections; and a controller coupled to the musical keyboard, the touchscreen, and the device connection interface.

2. The musical instrument of claim 1, further comprising:

an expansion interface coupled to the controller, wherein the expansion interface is configured to detect when the musical instrument is coupled adjacent to another instance of the musical instrument to form an expanded musical instrument.

3. The musical instrument of claim 1, further comprising:

a plurality of lights embedded within the plurality of first keys and the plurality of second keys, wherein the plurality of lights are operable to indicate which corresponding key to press.

4. The musical instrument of claim 1, further comprising:

a speaker aligned at a top of the plurality of first keys, wherein the speaker is configured to provide sound from the musical keyboard and the touchscreen.

5. The musical instrument of claim 1, wherein the device connection interface is configured to provide a connection to the Internet that is navigable via the touchscreen.

6. The musical instrument of claim 1, wherein the plurality of external connections comprises a headphone jack, a universal serial bus (USB) port, and a wireless network connection.

7. The musical instrument of claim 1, further comprising:

a location detector configured to determine a geographic location of the musical instrument.

8. The musical instrument of claim 1, further comprising:

a memory configured to store music created by using the musical keyboard.

9. The musical instrument of claim 1, further comprising:

a camera configured to capture video of a user of the musical instrument.

10. The musical instrument of claim 1, wherein the touch-screen extends substantially a width of the musical keyboard.

* * * * *